US009527326B2

(12) United States Patent
Kamoda

(10) Patent No.: US 9,527,326 B2
(45) Date of Patent: Dec. 27, 2016

(54) INKING DEVICE OF NUMBERING AND IMPRINTING MACHINE

(71) Applicant: KOMORI CORPORATION, Tokyo (JP)

(72) Inventor: Hiroyoshi Kamoda, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/484,312

(22) Filed: Sep. 12, 2014

(65) Prior Publication Data

US 2015/0075398 A1 Mar. 19, 2015

(30) Foreign Application Priority Data

Sep. 13, 2013 (JP) ..... 2013-190088

(51) Int. Cl.
*B41F 31/18* (2006.01)
*B41M 3/14* (2006.01)
(Continued)

(52) U.S. Cl.
CPC ..... *B41L 27/04* (2013.01); *B41F 13/0032* (2013.01); *B41F 31/00* (2013.01); *B41F 31/02* (2013.01);
(Continued)

(58) Field of Classification Search
CPC ..... B41F 31/13; B41F 31/18; B41F 13/0032; B41F 33/009; B41M 3/14
See application file for complete search history.

(56) References Cited

U.S. PATENT DOCUMENTS 309,220 A * 12/1884 Gally ..... B41F 31/18 101/208
3,939,766 A * 2/1976 Darwin ..... B41F 17/003 101/103
(Continued)

FOREIGN PATENT DOCUMENTS

| | | |
|---|---|---|
| EP | 2 052 860 A2 | 4/2009 |
| EP | 2 614 957 A1 | 7/2013 |
| JP | 3-049753 B2 | 7/1991 |

OTHER PUBLICATIONS

Extended European Search Report dated Mar. 9, 2015 issued in corresponding European Application No. 14 18 4592.5.

*Primary Examiner* — Daniel J Colilla
*Assistant Examiner* — Leo T Hinze
(74) *Attorney, Agent, or Firm* — Birch, Stewart, Kolasch & Birch, LLP

(57) ABSTRACT

An inking device of a numbering and imprinting machine includes: a numbering unit provided on an outer peripheral portion of a numbering cylinder and configured to print a code onto a transported sheet; a partition member configured to partition the inside of the ink fountain such that inks are stored divided by their colors inside the ink fountain; an ink fountain roller configured to draw out the inks stored in the divided manner inside the ink fountain, such that the inks appear side by side in the roller axial direction; select rollers onto which the inks fed from the ink fountain roller are transferred, respectively; oscillating rollers onto which the inks fed from the select rollers are transferred, respectively; and form rollers configured to rotate such that convex portions thereof, onto which the inks fed from the oscillating rollers are transferred, come into contact with the numbering unit.

3 Claims, 7 Drawing Sheets

(51) Int. Cl.

| | |
|---|---|
| ***B41L 27/04*** | (2006.01) |
| ***B41F 31/00*** | (2006.01) |
| ***B41F 31/02*** | (2006.01) |
| ***B41F 13/00*** | (2006.01) |
| ***B41L 19/00*** | (2006.01) |

(52) U.S. Cl.
CPC ..... *B41F 31/18* (2013.01); *B41L 19/00* (2013.01); *B41M 3/14* (2013.01)

(56) References Cited

U.S. PATENT DOCUMENTS

| | | | | |
|---|---|---|---|---|
| 4,092,020 | A * | 5/1978 | Blessing | D06H 1/02 101/228 |
| 4,718,344 | A * | 1/1988 | Lemaster | 101/483 |
| 4,991,504 | A * | 2/1991 | Fina | 101/208 |
| 6,928,927 | B2 * | 8/2005 | Endo | 101/153 |
| 7,806,051 | B2 * | 10/2010 | Schaede | 101/152 |
| 8,001,890 | B2 * | 8/2011 | Endres et al. | 101/205 |
| 2013/0180419 | A1 * | 7/2013 | Endo et al. | 101/76 |

* cited by examiner

INKING DEVICE OF NUMBERING AND IMPRINTING MACHINE

TECHNICAL FIELD

The present invention relates to an inking device of a numbering and imprinting machine configured to feed inks of multiple colors to numbering units provided on a numbering cylinder.

BACKGROUND ART

Numbering and imprinting for printing serial codes on securities, banknotes, and the like has been done by additionally printing such codes on printed products which have already been subjected to printing such as offset printing or intaglio printing. Moreover, numbering cylinders of numbering and imprinting machines capable of such numbering and imprinting include numbering units having carved letters of predetermined digits. These numbering units are configured to be fed with an ink stored in an ink fountain through a number of rollers.

Patent Literature 1, for example, discloses an inking device of a numbering and imprinting machine as described above which is capable of feeding an ink to numbering units of a numbering cylinder.

CITATION LIST

Patent Literature

{Patent Literature 1}Japanese Examined Patent Application Publication No. Hei 3-49753

SUMMARY OF INVENTION

Technical Problem

However, in the above conventional inking device, there is only one ink feed path, and printed codes are therefore expressed with only one color. In a case particularly where printed products are securities, banknotes, or the like as mentioned above, those printed products need many anti-counterfeit measures. In this case, expressing the codes of the printed products with multiple colors may provide a higher anti-counterfeit effect.

Thus, the present invention has been made to solve the above problem, and an object thereof is to provide an inking device of a numbering and imprinting machine capable of expressing a printed code with multiple colors to thereby provide a high anti-counterfeit effect to a printed product.

Solution to Problem

In inking device of a numbering and imprinting machine according to a first aspect of the invention for solving the above problem provides an inking device of a numbering and imprinting machine, the inking device being configured to feed inks stored inside an ink fountain onto a numbering cylinder configured to print a code onto a transported sheet, the inking device including: a numbering unit provided on an outer peripheral portion of the numbering cylinder and configured to print a code onto a transported sheet; a partition member configured to partition an inside of the ink fountain in such a manner that inks of a plurality of colors are stored divided by the colors inside the ink fountain; an ink fountain roller configured to draw out the inks of the plurality of colors stored in the divided manner inside the ink fountain, in such a manner that the inks appear side by side in an axial direction of the ink fountain roller; a plurality of select rollers onto which at least one of the inks of the plurality of colors fed from the ink fountain roller is selectively transferred; a plurality of oscillating rollers which are provided respectively for the select rollers and supported in such a manner as to be movable in an axial direction of the oscillating rollers, and onto which the inks fed from the select rollers are transferred; and a plurality of form rollers provided respectively for the oscillating rollers, including convex portions on outer peripheral surfaces thereof, and configured to rotate in such a manner that the convex portions come into contact with the numbering unit, the convex portions being portions onto which the inks fed from the oscillating rollers are transferred.

An inking device of a numbering and imprinting machine according to a second aspect of the invention for solving the above problem is such that an annular convex portion onto which the inks fed from the ink fountain roller are transferred is formed on an outer peripheral surface of each of the select rollers in a convex shape over an entire area in a circumferential direction thereof, and one or more of the annular convex portions are disposed side by side in an axial direction of the select roller.

An inking device of a numbering and imprinting machine according to a third aspect of the invention for solving the above problem is such that a circumferential length of the numbering cylinder is a multiple integer of circumferential lengths of the form rollers, and the plurality of form rollers and the numbering cylinder rotate in synchronization with each other.

Advantageous Effect of Invention

Thus, with the inking device of a numbering and imprinting machine according to the present invention, a code can be printed on a sheet with multiple colors used for different portions. Accordingly, the printed code can be expressed with multiple colors, and therefore a high-counterfeit effect can be provided to the printed product.

DESCRIPTION OF EMBODIMENT

Hereinafter, an inking device of a numbering and imprinting machine according to the present invention will be described in detail with reference to the drawings.

Embodiment

Figure 1:
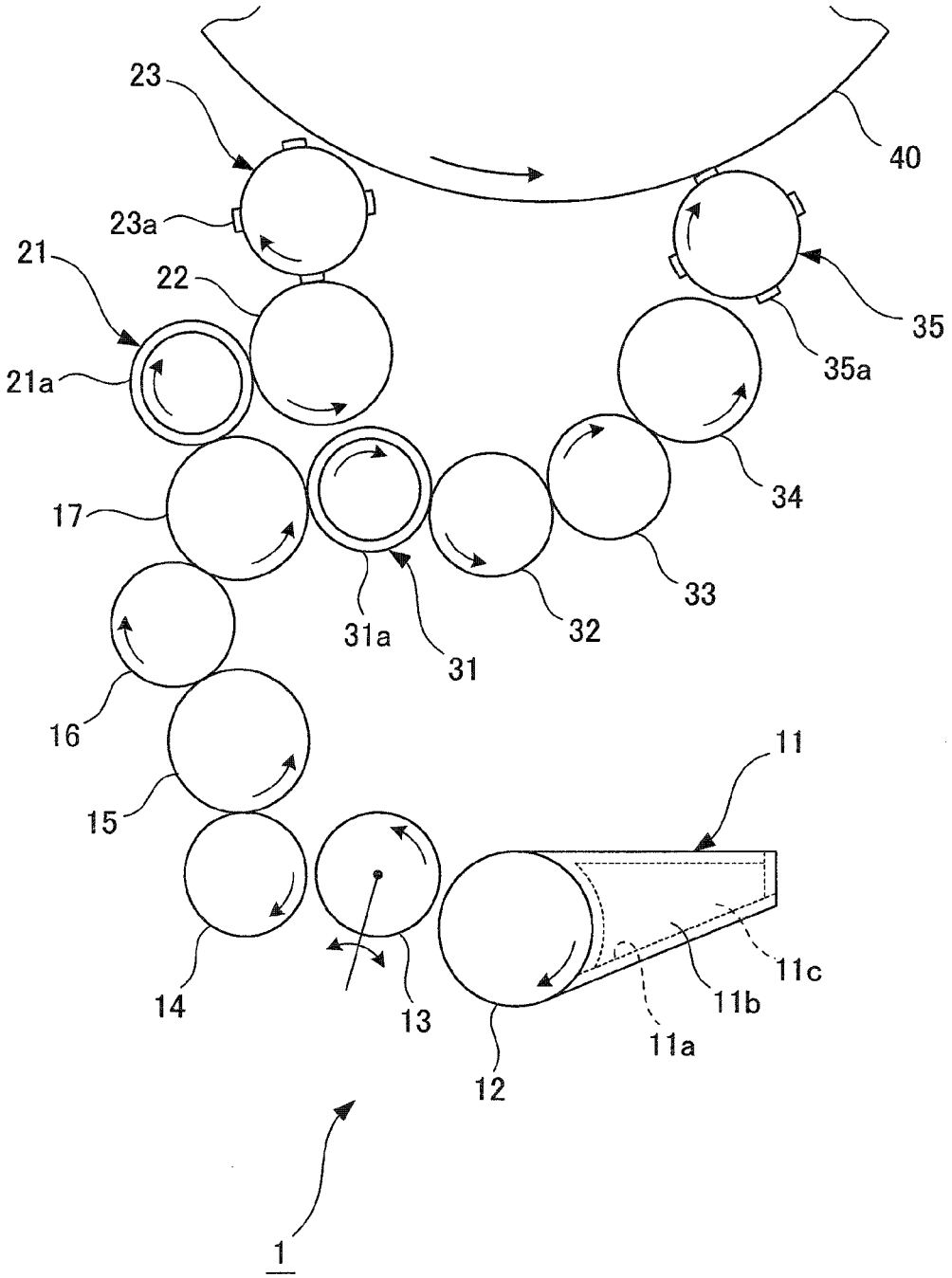
FIG. 1 is a side view of an inking device of a numbering and imprinting machine according to one embodiment of the present invention.
Figure 6:
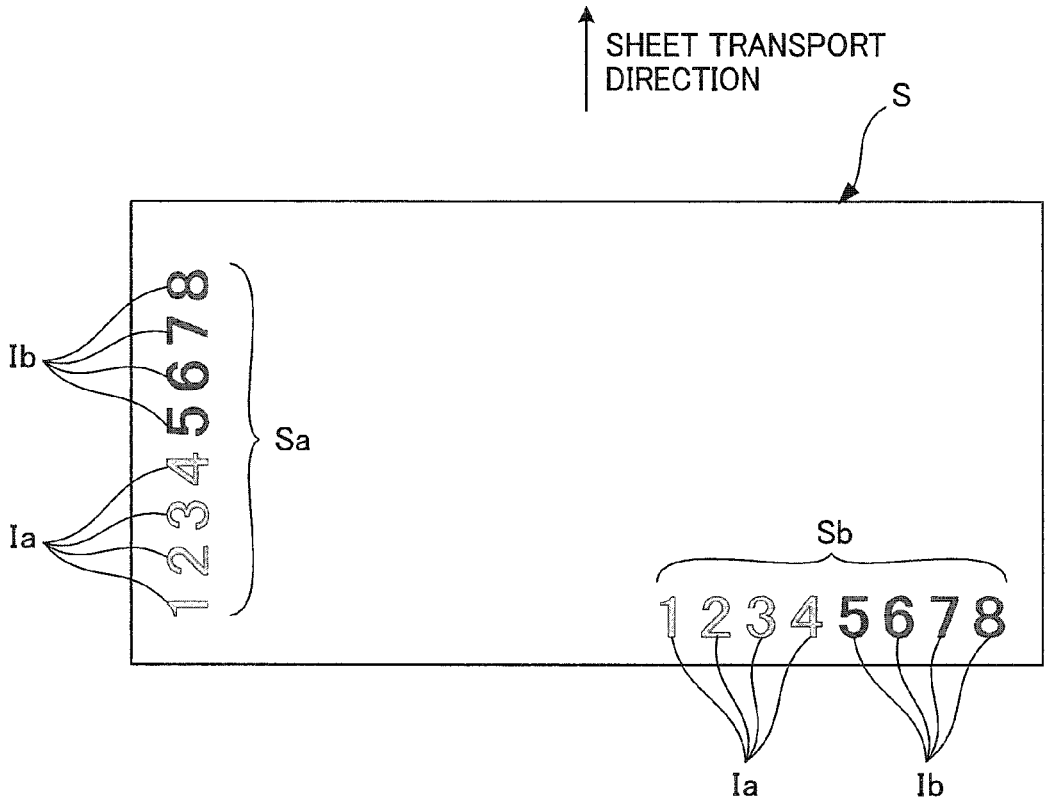
FIG. 6 is a view showing a sheet on which codes are printed.

As shown in FIG. 1, a numbering and imprinting machine includes an inking device 1. Here, the numbering and imprinting machine is configured to print serial codes on transported sheets S. Moreover, as shown in FIG. 6, a sheet S subjected to the numbering and imprinting by the numbering and imprinting machine has, for example, a lengthwise code Sa and a widthwise code Sb printed thereon.

The lengthwise code Sa is a multiple-digit code arranged in one line in the sheet lengthwise direction on one end side in the sheet widthwise direction (left side in the sheet widthwise direction). The widthwise code Sb is a multiple-digit code arranged in one line in the sheet widthwise direction on the other end side in the sheet widthwise direction (right side in the sheet widthwise direction). Note that the lengthwise code Sa and the widthwise code Sb will each be described as an eight-digit code in this embodiment.

Here, the lengthwise code Sa and the widthwise code Sb are each expressed by using inks Ia, Ib of multiple colors. Specifically, the first four digits of the lengthwise code Sa and the widthwise code Sb are printed by using only the ink Ia of a first color (one color), while the last four digits of the lengthwise code Sa and the widthwise code Sb are printed by using only the ink Ib of a second color (another color).

To do so, the inking device 1 is capable of supplying the inks Ia, Ib of multiple colors and is provided below a transported sheet S.

Next, the structure of the inking device 1 will be described in detail with reference to drawings.

First of all, the above-mentioned numbering and imprinting machine is configured to transport a sheet S in the lengthwise direction thereof. Thus, the sheet lengthwise direction corresponds to the sheet transport direction, and the sheet widthwise direction corresponds to a direction perpendicular to the sheet transport direction. Further, in the inking device 1 to be described below, the axial directions of rollers that form the inking device 1 correspond to the sheet widthwise direction, and the circumferential directions of these rollers corresponds to the sheet lengthwise direction.

Figure 2:
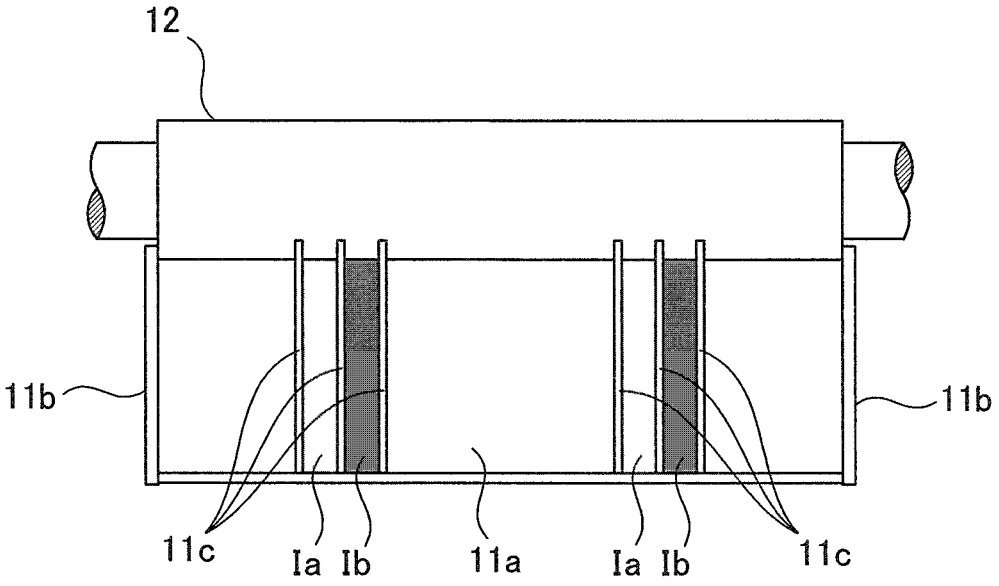
FIG. 2 is a plan view of an ink fountain.

As shown in FIGS. 1 and 2, an ink fountain 11 is provided at a lower portion of the inking device 1, and an ink fountain roller 12 is in rotatable contact with this ink fountain 11. The ink fountain 11 includes a bottom plate 11*a*, a pair of left and right side plates 11*b*, and multiple partition members 11*c*.

The bottom plate 11*a* is inclined downward toward the ink fountain roller 12. Moreover, the side plates 11*b* are fixed to left and right side portions of the bottom plate 11*a*. Furthermore, the partition members 11*c* are disposed between the pair of left and right side plates 11*b* and supported in such a manner as to be movable in the widthwise direction of the bottom plate 11*a* (axial direction of the ink fountain roller 12).

Specifically, the inks Ia, Ib of different colors can be stored respectively in spaces surrounded by the bottom plate 11*a*, the side plates 11*b*, the partition members 11*c*, and the outer peripheral surface of the ink fountain roller 12. Among these parts, the positions of the partition members 11*c* are adjusted in the axial direction of the ink fountain roller 12 based on the positions of the lengthwise code Sa and the widthwise code Sb on the sheet S in the sheet widthwise direction. For example, as shown in FIG. 2, the inks Ia, Ib are stored between pairs of adjacent partitioning plates 11*c*.

Moreover, as shown in FIG. 1, an ink ductor roller 13 and a distribution roller 14 are rotatably supported in front of the ink fountain roller 12. Among these rollers, the ink ductor roller 13 is supported in such a manner as to be swingable between the ink fountain roller 12 and the distribution roller 14 and can therefore be in contact alternately with the ink fountain roller 12 and the distribution roller 14.

Further, a drive roller 15 is in rotatable contact with the distribution roller 14 at a position downstream of the contact position with the ink ductor roller 13 in the rotational direction of the distribution roller 14 (downstream in the direction of the ink feed). In addition, a distribution roller 16 is in rotatable contact with the drive roller 15 at a position downstream of the contact position with the distribution roller 14 in the rotational direction of the drive roller 15. Also, a drive roller 17 is in rotatable contact with the distribution roller 16 at a position downstream of the contact position with the drive roller 15 in the rotational direction of the distribution roller 16.

Furthermore, a select roller 31 is in rotatable contact with the drive roller 17 at a position downstream of the contact position with the distribution roller 16 in the rotational direction of the drive roller 17. Also, a select roller 21 is in rotatable contact with the drive roller 17 at a position downstream of the contact position with the select roller 31 in the rotational direction of the drive roller 17.

Note that the select rollers 21, 31 are distribution rollers onto which the inks Ia, Ib fed from the drive roller 17 are transferred individually. As will be described later in detail, of the inks Ia, Ib fed to the drive roller 17, at least the ink Ia of a given color is selectively transferred onto the select roller 21 from the drive roller 17. On the other hand, of the inks Ia, Ib fed to the drive roller 17, at least the ink Ib of a given color is selectively transferred onto the select roller 31 from the drive roller 17.

An oscillating roller 22 is in rotatable contact with the select roller 21 at a position downstream of the contact position with the drive roller 17 in the rotational direction of the select roller 21. Moreover, a form roller 23 is in rotatable contact with the oscillating roller 22 at a position downstream of the contact position with the select roller 21 in the rotational direction of the oscillating roller 22. Furthermore, a numbering cylinder 40 of the numbering and imprinting machine is in rotatable contact with the form roller 23 at a position downstream of the contact position with the oscillating roller 22 in the rotational direction of the form roller 23.

Figure 4A:
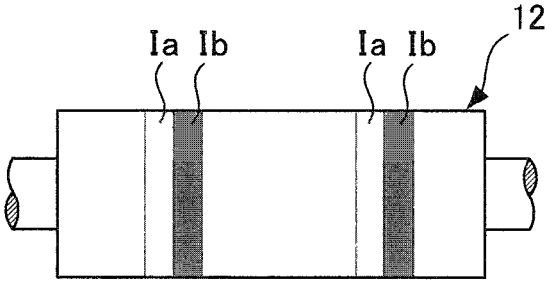
FIGS. 4A to 4E are views sequentially showing how one ink is fed.
Figure 4B:
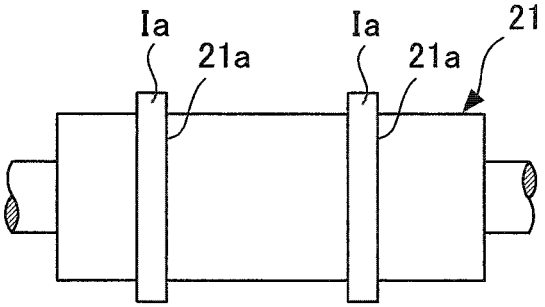

Here, as shown in FIG. 4B, multiple annular convex portions 21*a* are formed on the outer peripheral surface of the select roller 21 in a convex shape over the entire area in the circumferential direction. Thus, the ink Ia is transferred only onto the outer peripheral surfaces (top surfaces) of the annular convex portions 21*a* of the select roller 21.

Specifically, the positions of the annular convex portions 21*a* in the select-roller axial direction are positions corresponding to the ink Ia selected from among the inks Ia, Ib fed side by side in the select-roller axial direction, and also corresponding respectively to the position of the lengthwise code Sa on the sheet S in the sheet widthwise direction and the position of the first-four-digit portion of the widthwise code Sb on the sheet S in the sheet widthwise direction.

Moreover, the oscillating roller 22 is supported in such a manner as to be movable in the axial direction thereof, and therefore oscillates by a predetermined oscillation width. Further, as shown in FIG. 4D, multiple convex portions 23*a*, 23*b* are formed on the outer peripheral surface of the form roller 23 in convex shapes along the circumferential direction thereof. Thus, the ink Ia is transferred only onto the outer peripheral surfaces (top surfaces) of the convex portions 23*a*, 23*b* of the form roller 23.

Specifically, the position of each convex portion 23*a* in the form-roller axial direction corresponds to the position of the lengthwise code Sa on the sheet S in the sheet widthwise direction, and the position of the convex portion 23*a* in the form-roller circumferential direction corresponds to the position of the first-four-digit portion of the lengthwise code Sa on the sheet S in the sheet lengthwise direction. On the other hand, the position of each convex portion 23*b* in the form-roller axial direction corresponds to the position of the first-four-digit portion of the widthwise code Sb on the sheet S in the sheet widthwise direction, and the position of the convex portion 23*b* in the form-roller circumferential direction corresponds to the position of the widthwise code Sb on the sheet S in the sheet lengthwise direction.

On the other hand, a distribution roller 32 is in rotatable contact with the select roller 31 at a position downstream of the contact position with the drive roller 17 in the rotational direction of the select roller 31, and a distribution roller 33 is in rotatable contact with this distribution roller 32 at a position downstream of the contact position with the select roller 31 in the rotational direction of the distribution roller 32. Further, an oscillating roller 34 is in rotatable contact with the distribution roller 33 at a position downstream of the contact position with the distribution roller 32 in the rotational direction of the distribution roller 33, and a form roller 35 is in rotatable contact with this oscillating roller 34 at a position downstream of the contact position with the distribution roller 33 in the rotational direction of the oscillating roller 34. Furthermore, the numbering cylinder 40 is in rotatable contact with the form roller 35 at a position downstream of the contact position with the oscillating roller 34 in the rotational direction of the form roller 35.

Note that an impression cylinder (not shown) of the numbering and imprinting machine is in rotatable contact with the numbering cylinder 40 at a position downstream of the contact position with the form roller 35 in the rotational direction of the numbering cylinder 40. This impression cylinder is configured to hold and transport the sheet S.

Figure 5A:
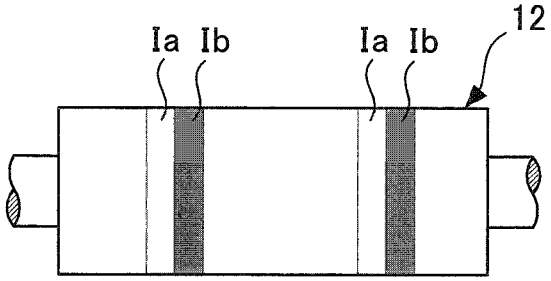
FIGS. 5A to 5E are views sequentially showing how another ink is fed.
Figure 5B:
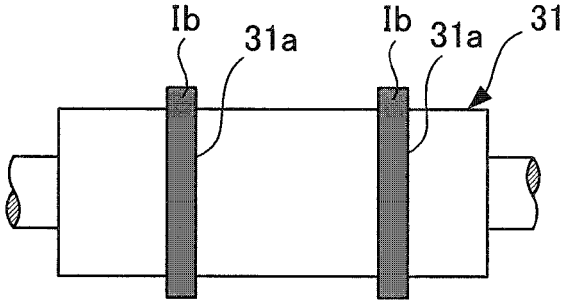

Here, as shown in FIG. 5B, multiple annular convex portions 31*a* are formed on the outer peripheral surface of the select roller 31 in a convex shape over the entire area in the circumferential direction thereof. Thus, the ink Ib is transferred only onto the outer peripheral surfaces (top surfaces) of the annular convex portions 31*a* of the select roller 31.

Specifically, the positions of the annular convex portions 31*a* in the select-roller axial direction are positions corresponding to the ink Ib selected from among the inks Ia, Ib fed side by side in the select-roller axial direction, and also corresponding respectively to the position of the lengthwise code Sa on the sheet S in the sheet widthwise direction and the position of the last-four-digit portion of the widthwise code Sb on the sheet S in the sheet widthwise direction.

Moreover, the oscillating roller 34 is supported in such a manner as to be movable in the axial direction thereof and therefore oscillates by a predetermined oscillation width. Further, as shown in FIG. 5D, multiple convex portions 35*a*, 35*b* are formed on the outer peripheral surface of the form roller 35 in convex shapes along the circumferential direction. Thus, the ink Ib is transferred only onto the outer peripheral surfaces of the convex portions 35*a*, 35*b* of the form roller 35.

Specifically, the position of each convex portion 35*a* in the form-roller axial direction corresponds to the position of the lengthwise code Sa on the sheet S in the sheet widthwise direction, and the position of the convex portion 35*a* in the form-roller circumferential direction corresponds to the position of the last-four-digit portion of the lengthwise code Sa on the sheet S in the sheet lengthwise direction. On the other hand, the position of each convex portion 35*b* in the form-roller axial direction corresponds to the position of the last-four-digit portion of the widthwise code Sb on the sheet S in the sheet widthwise direction, and the position of the convex portion 35*b* in the form-roller circumferential direction corresponds to the position of the widthwise code Sb on the sheet S in the sheet lengthwise direction.

Figure 3:
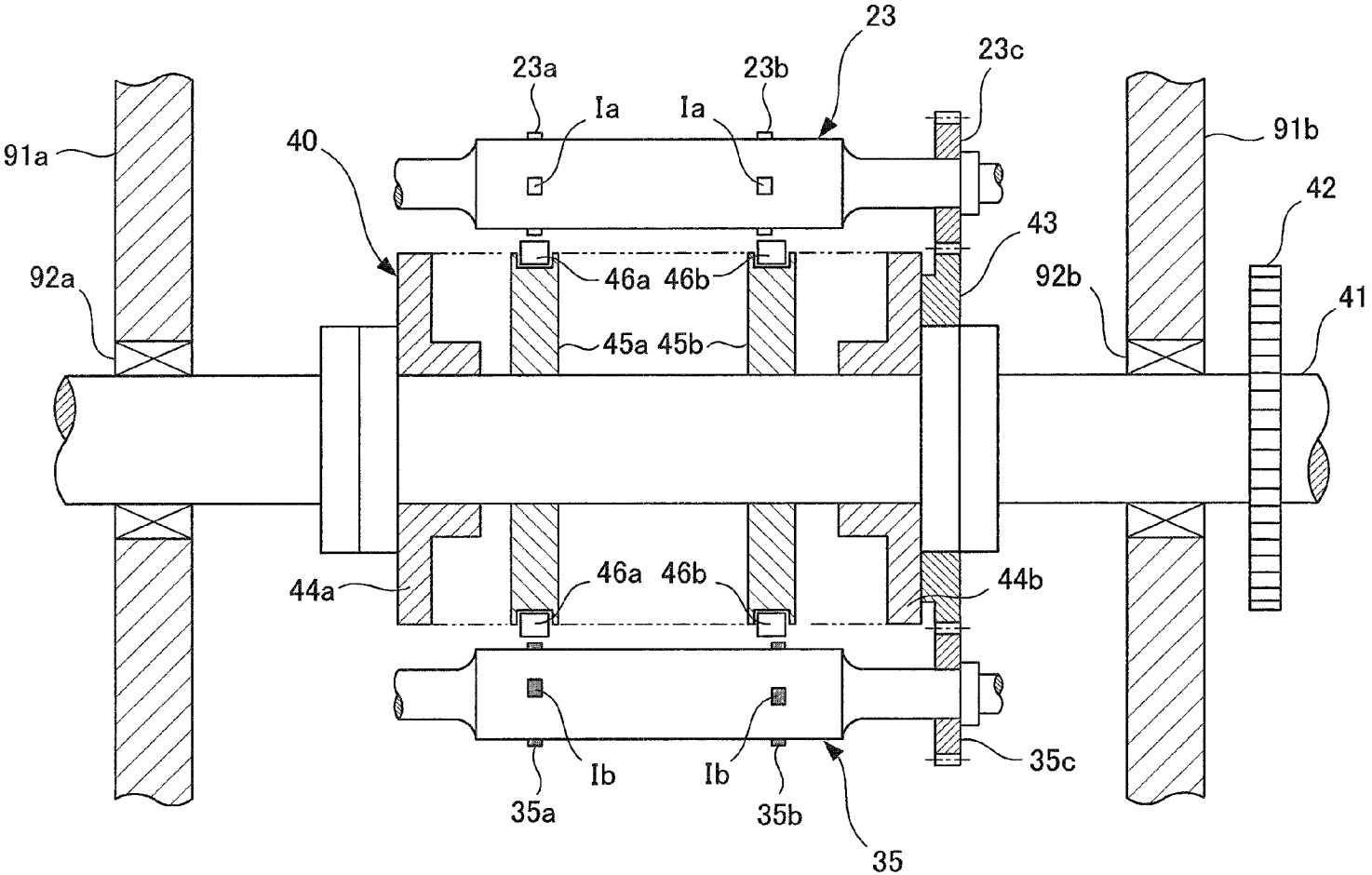
FIG. 3 is a view showing the positional relationship between form rollers and a numbering cylinder.

Next, as shown in FIG. 3, the numbering cylinder 40 includes a numbering cylinder shaft 41 at the center thereof. Left and right end portions of this numbering cylinder shaft 41 are rotatably supported on a pair of left and right frames 91*a*, 91*b* of the numbering and imprinting machine with bearings 92*a*, 92*b* interposed therebetween, respectively. Further, a drive gear 42 is fitted on the numbering cylinder shaft 41 at the outer side of the frame 91*b*, and a coupling gear 43 is fitted on the numbering cylinder shaft 41 at the inner side of the frame 91*b*.

The drive gear 42 is a gear to which drive of a main-unit drive motor (not shown) configured to drive the entire numbering and imprinting machine is transmitted. On the other hand, the coupling gear 43 is in mesh with coupling gears 23*c*, 35*c* disposed coaxially with the rotary shafts of the form rollers 23, 35, respectively. Thus, as the numbering and imprinting machine is driven, the numbering cylinder 40 and the form rollers 23, 35 are rotated in synchronization with each other. Note that the circumferential length of the numbering cylinder 40 is a multiple integer of the circumferential lengths of the form rollers 23, 35.

Moreover, a pair of left and right circular support plates 44*a*, 44*b* and a pair of left and right ring members 45*a*, 45*b* are fitted on the numbering cylinder shaft 41 in such a manner as to face the form rollers 23, 35. Moreover, the positions of the ring members 45*a*, 45*b* can be adjusted in the numbering-cylinder axial direction. The circular support plates 44*a*, 44*b* are provided at the left and right sides of the ring members 45*a*, 45*b*, respectively, and the outer peripheral surfaces of the circuit support plates 44*a*, 44*b* serve as a reference position for adjusting the gap between (the distance between the axes of) the numbering cylinder 40 and the impression cylinder.

Further, multiple numbering units 46*a*, 46*b* are provided on outer peripheral portions of the ring members 45*a*, 45*b*, respectively, at an equal interval in the circumferential direction thereof. Each numbering unit 46*a* is configured to print a given lengthwise code Sa onto a sheet S, and an eight-digit number arranged in one line in the numbering-cylinder circumferential direction is carved in the form of a relief printing plate on an outer peripheral portion of the numbering unit 46*a*. Moreover, the convexly carved eight-digit number of the numbering unit 46*a* increments for each printing of a sheet, and also a digit(s) increments at every ten increments. On the other hand, each numbering unit 46*b* is configured to print a given widthwise code Sb onto a sheet S, and an eight-digit number arranged in one line in the numbering-cylinder axial direction are carved in the form of a relief printing plate on an outer peripheral portion of the numbering unit 46*b*. Moreover, the convexly carved eight-digit number of the numbering unit 46*b* increments for each printing of a sheet, and also a digit(s) increments at every ten increments.

Specifically, the numbering units 46*a* on the ring member 45*a* are located at the same positions as the convex portions 23*a*, 35*a* of the form rollers 23, 35, and the lengthwise code Sa on the sheet S in the numbering-cylinder axial direction (form-roller axial direction, sheet widthwise direction).

Further, the convex portions 23*a*, 35*a* and the numbering units 46*a* can always come into contact with each other by the synchronous rotation of the form rollers 23, 35 and the numbering cylinder 40. Specifically, each convex portion 23*a* comes into contact with the first-four-digit portion of the convexly carved eight-digit number of a given one of the numbering units 46*a* to transfer the ink Ia onto that portion. On the other hand, each convex portion 35*a* comes into contact with the last-four-digit portion of the convexly carved eight-digit number of a given one of the numbering units 46*a* to transfer the ink Ib onto that portion.

Similarly, the numbering units 46*b* on the ring member 45*b* are located at the same positions as the convex portions 23*b*, 35*b* of the form rollers 23, 35, and the widthwise code Sb on the sheet S in the numbering-cylinder axial direction (form-roller axial direction, sheet widthwise direction).

Further, the convex portions 23*b*, 35*b* and the numbering units 46*b* can always come into contact with each other by the synchronous rotation of the form rollers 23, 35 and the numbering cylinder 40. Specifically, each convex portion 23*b* comes into contact with the first-four-digit portion of the convexly carved eight-digit number of a given one of the numbering units 46*b* to transfer the ink Ia onto that portion. On the other hand, each convex portion 35*b* comes into contact with the last-four-digit portion of the convexly carved eight-digit number of a given one of the numbering units 46*b* to transfer the ink Ib onto that portion.

Next, the ink feed operation of the inking device 1 will be described in detail with reference drawings.

First, as shown in FIGS. 2, 4A, and 5A, the inks Ia, Ib have been stored in the spaces partitioned by the multiple partition members 11*c* inside the ink fountain 11. Thus, as the ink fountain roller 12 is rotated, these stored inks Ia, Ib are transferred next to each other (side by side) in the ink-fountain-roller axial direction onto the outer peripheral surface of the ink fountain roller 12.

Thereafter, as shown in FIG. 1, the inks Ia, Ib fed to the ink fountain roller 12 are transferred onto the outer peripheral surface of the distribution roller 14 by swing of the ink ductor roller 13, and then transferred onto the outer peripheral surface of the drive roller 17 via the outer peripheral surfaces of the drive roller 15 and distribution roller 16.

Here, as shown in FIG. 4B, of the inks Ia, Ib transferred onto the drive roller 17, the ink Ia is transferred onto the outer peripheral surfaces of the annular convex portions 21*a* of the select roller 21.

Figure 4C:
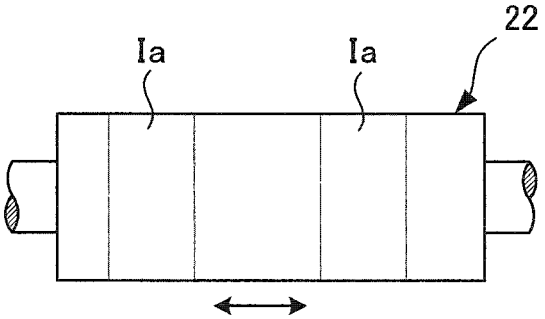
Figure 4D:
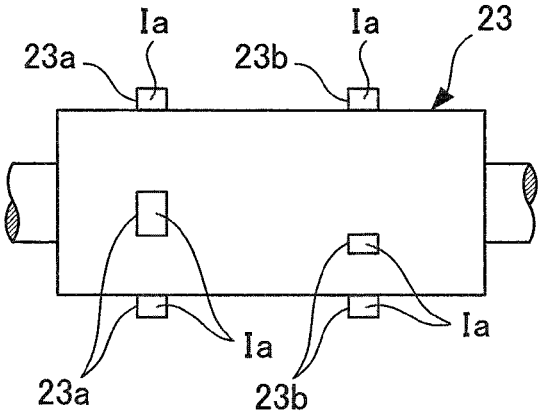

Then, as shown in FIG. 4C, the ink Ia transferred onto the annular convex portions 21*a* of the select roller 21 is transferred onto the outer peripheral surface of the oscillating roller 22. In this step, the oscillating roller 22 is oscillating by the predetermined oscillation width in the oscillating-roller axial direction.

When the ink Ia is transferred from the annular convex portions 21*a* of the select roller 21 onto the oscillating roller 22 as described above, the oscillating movement of the oscillating roller 22 widens the width of ink transfer on the outer peripheral surface of the oscillating roller 22 in the oscillating-roller axial direction to a greater width than the width of ink transfer on the outer peripheral surfaces of the annular convex portions 21*a* in the select-roller axial direction.

Then, as shown in FIG. 4D, the ink Ia transferred onto the oscillating roller 22 is transferred onto the outer peripheral surfaces of the convex portions 23*a*, 23*b* of the form roller 23.

Thereafter, as shown in FIG. 3, the ink Ia transferred onto the convex portions 23*a*, 23*b* of the form roller 23 is transferred onto the numbering units 46*a*, 46*b* of the numbering cylinder 40, respectively. Specifically, the ink Ia transferred onto one of the convex portions 23*a* is transferred onto the first-four-digit portion of the convexly carved number of one of the numbering units 46*a*, while the ink Ia transferred onto one of the convex portions 23*b* is transferred onto the first-four-digit portion of the convexly carved number of one of the numbering units 46*b*.

Figure 4E:
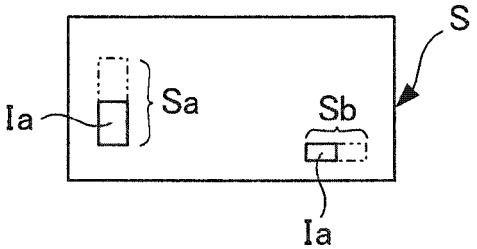

Then, as shown in FIG. 4E, the ink Ia transferred onto the numbering unit 46*a* is transferred onto a sheet S transported to a position at which the numbering cylinder 40 and the impression cylinder face each other, to thereby print the first four digits of the lengthwise code Sa. Also, the ink Ia transferred onto the numbering unit 46*b* is transferred onto the sheet S transported to the position at which the numbering cylinder 40 and the impression cylinder face each other, to thereby print the first four digits of the widthwise code Sb.

On the other hand, as shown in FIG. 5B, of the inks Ia, Ib transferred onto the drive roller 17, the ink Ib is transferred onto the outer peripheral surfaces of the annular convex portions 31*a* of the select roller 31.

Figure 5C:
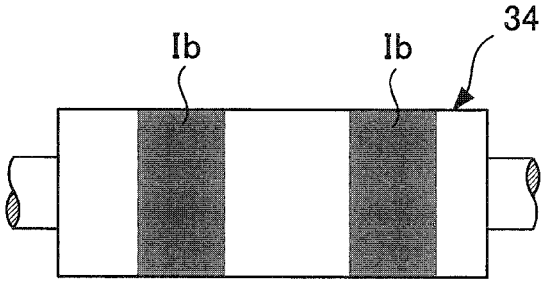
Figure 5D:
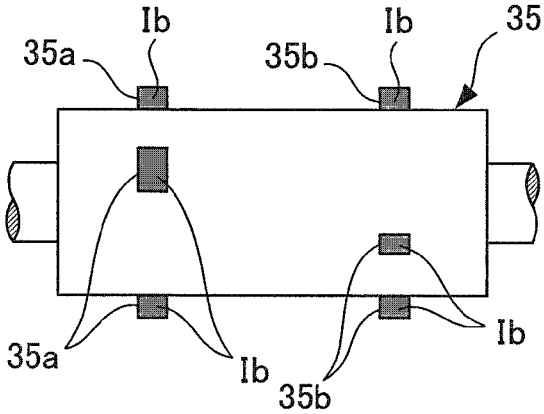

Then, as shown in FIG. 5C, the ink Ib transferred onto the annular convex portions 31*a* of the select roller 31 is transferred onto the outer peripheral surface of the oscillating roller 34 via the outer peripheral surfaces of the distribution rollers 32, 33. In this step, the oscillating roller 34 is oscillating by the predetermined oscillation width in the oscillating-roller axial direction.

When the ink Ib is transferred from the annular convex portions 31*a* of the select roller 31 onto the oscillating roller 34 as described above, the oscillating movement of the oscillating roller 34 widens the width of ink transfer on the outer peripheral surface of the oscillating roller 34 in the oscillating-roller axial direction to a greater width than the width of ink transfer on the outer peripheral surfaces of the annular convex portions 31*a* in the select-roller axial direction.

Then, as shown in FIG. 5D, the ink Ib transferred onto the oscillating roller 34 is transferred onto the outer peripheral surfaces of the convex portions 35*a*, 35*b* of the form roller 35.

Thereafter, as shown in FIG. 3, the ink Ib transferred onto the convex portions 35*a*, 35*b* of the form roller 35 is transferred onto the numbering units 46*a*, 46*b* of the numbering cylinder 40, respectively. Specifically, the ink Ib transferred onto one of the convex portions 35*a* is transferred onto the last-four-digit portion of the convexly carved number of one of the numbering units 46*a*, while the ink Ib transferred onto the convex portions 35*b* is transferred onto the last-four-digit portion of the convexly carved number of one of the numbering units 46*b*.

Figure 5E:
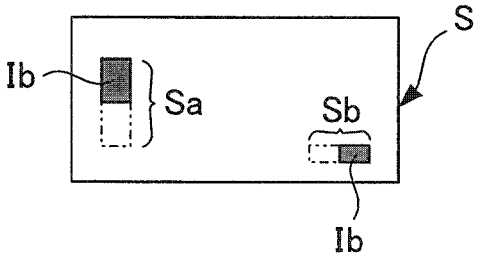

Then, as shown in FIG. 5E, the ink Ib transferred onto the numbering unit 46*a* is transferred onto the sheet S transported to the position at which the numbering cylinder 40 and the impression cylinder face each other, to thereby print the last four digits of the lengthwise code Sa. Also, the ink Ib transferred onto the numbering unit 46*b* is transferred onto the sheet S transported to the position at which the numbering cylinder 40 and the impression cylinder face each other, to thereby print the last four digits of the widthwise code Sb.

According to the above operation, the inks Ia, Ib of different colors are transferred onto different portions of the numbering unit 46*a* of the numbering cylinder 40, and the inks Ia, Ib of the different colors are transferred onto different portions of the numbering unit 46*b* of the numbering cylinder 40. As a result, as shown in FIG. 6, the lengthwise code Sa and the widthwise code Sb each having the two different colors in different portions are printed onto a transported sheet S.

Thus, with the inking device 1 of the numbering and imprinting machine according to the present invention, the lengthwise code Sa and the widthwise code Sb can each be printed onto a sheet S in a different color for each half digits. Accordingly, the printed codes can be expressed with multiple colors, and a high anti-counterfeit effect can therefore be provided to the printed product.

In the embodiment described above, the serial code printed by each of the numbering units 46*a*, 46*b* of the numbering cylinder 40 is a code with only numbers. Note, however, that the serial code may be a code with a combination of numbers and letters, a code with a combination of numbers and signs, or a code with only signs.

Figure 7:
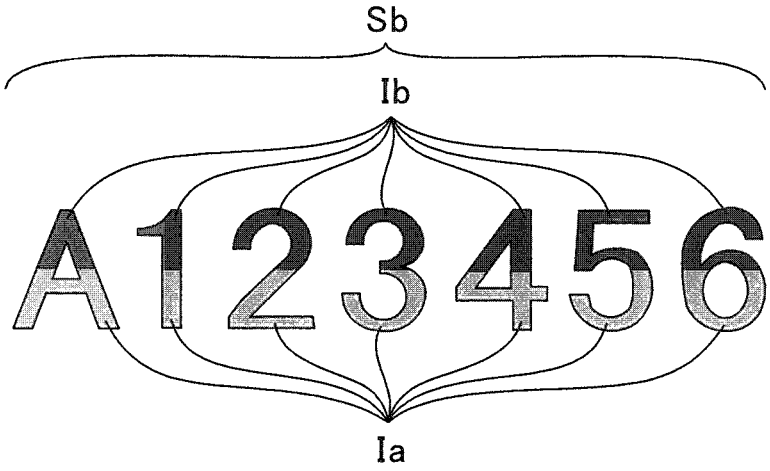
FIG. 7 is an example of use of different colors in printing a code with a combination of numbers and a letter.

For example, when a seven-digit widthwise code Sb with a combination of numbers and a letter as shown in FIG. 7 is to be printed on a sheet S, the positions of the convex portions 23*b*, 35*b* of the form rollers 23, 35 in the form-roller axial direction and the form-roller circumferential direction may be adjusted such that an upstream portion of the widthwise code Sb in the sheet transport direction can be printed with the ink Ia, and a downstream portion of the widthwise code Sb in the sheet transport direction can be printed with the ink Ib.

Figure 8:
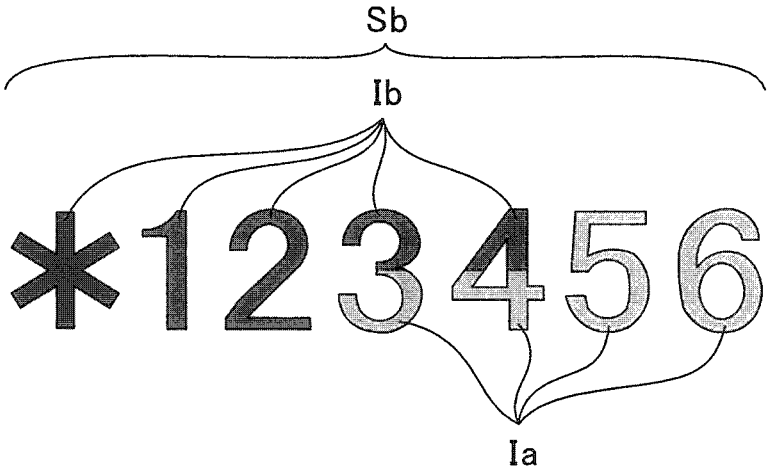
FIG. 8 is an example of use of different colors in printing a code with a combination of numbers and a sign.

Moreover, when a seven-digit widthwise code Sb with a combination of numbers and a sign as shown in FIG. 8 is to be printed on a sheet S, the positions of the convex portions 23*b*, 35*b* of the form rollers 23, 35 in the form-roller axial direction and the form-roller circumferential direction may be adjusted such that upstream portions of only certain digits (only selected digits) of the widthwise code Sb in the sheet transport direction can be printed with the ink Ia, and a downstream portion of only the certain digits of the widthwise code Sb in the sheet transport direction can be printed with the ink Ib.

Thus, the widthwise code Sb can be printed on a sheet S with different colors in the upstream portion(s) in the sheet transport direction and the downstream portion(s) in the sheet transport direction. Accordingly, even in a case of a code with a combination of numbers and letters or signs, the code can be expressed with multiple colors, and a high anti-counterfeit effect can therefore be provided to the printed product.

INDUSTRIAL APPLICABILITY

The present invention is applicable to inking devices of numbering and imprinting machines capable of maintaining the thickness of ink constant.

REFERENCE SIGNS LIST

1 INKING DEVICE
11 INK FOUNTAIN
11*c* PARTITION MEMBER
12 INK FOUNTAIN ROLLER
21 SELECT ROLLER
21*a* ANNULAR CONVEX PORTION
22 OSCILLATING ROLLER
23 FORM ROLLER
23*a*, 23*b* CONVEX PORTION
31 SELECT ROLLER
31*a* ANNULAR CONVEX PORTION
34 OSCILLATING ROLLER
35 FORM ROLLER
35*a*, 35*b* CONVEX PORTION
40 NUMBERING CYLINDER
46*a*, 46*b* NUMBERING UNIT
Ia, Ib INK
S SHEET
Sa LENGTHWISE CODE
Sb WIDTHWISE CODE

The invention claimed is:

1. An inking device of a numbering and imprinting machine, the inking device being configured to feed inks stored inside an ink fountain onto a numbering cylinder configured to print a code onto a transported sheet, the inking device comprising:

a numbering unit provided on an outer peripheral portion of the numbering cylinder and configured to print a code onto a transported sheet;

a partition member configured to partition an inside of the ink fountain in such a manner that inks of a plurality of colors are stored divided by the colors inside the ink fountain;

an ink fountain roller configured to draw out the inks of the plurality of colors stored in the divided manner inside the ink fountain, in such a manner that the inks appear side by side in an axial direction of the ink fountain roller;

one select roller onto which only one ink among the inks of the plurality of colors fed from the ink fountain roller is selectively transferred;

one oscillating roller which is provided for the one select roller and supported in such a manner as to be movable in an axial direction of the one oscillating roller, and onto which the one ink fed from the one select roller is transferred;

one form roller provided for the one oscillating roller, including one convex portion on an outer peripheral surface thereof, and configured to rotate in such a manner that the one convex portion comes into contact with the numbering unit, the one convex portion being a portion onto which the one ink fed from the one oscillating roller is transferred;

another select roller onto which, among the inks of the plurality of colors fed from the ink fountain roller, only another ink of a color different from the color of the ink transferred onto the one select roller is transferred;

another oscillating roller which is provided for the another select roller and supported in such a manner as to be movable in an axial direction of the another oscillating roller, and onto which the another ink fed from the another select roller is transferred; and another form roller provided for the another oscillating roller, including another convex portion on an outer peripheral surface thereof, and configured to rotate in such a manner that the another convex portion comes into contact with the numbering unit, the another convex portion being a portion onto which the another ink fed from the other oscillating roller is transferred.

2. The inking device of a numbering and imprinting machine according to claim 1, wherein an annular convex portion onto which the one ink and the another ink fed from the ink fountain roller are transferred is formed on an outer peripheral surface of each of the one select roller and the another select roller in a convex shape over an entire area in a circumferential direction thereof, and one or more of the annular convex portions are disposed side by side in an axial direction of each of the one select roller and the another select roller.

3. The inking device of a numbering and imprinting machine according to claim 1, wherein a circumferential length of the numbering cylinder is a multiple integer of circumferential lengths of the one form roller and the another form roller, and the one form roller, the another form roller, and the numbering cylinder rotate in synchronization with each other.

* * * * *